US008991020B2

(12) United States Patent
Sasur

(10) Patent No.: US 8,991,020 B2
(45) Date of Patent: Mar. 31, 2015

(54) HAND HELD FELTING MACHINE

(75) Inventor: David Sasur, Ludlow, MA (US)

(73) Assignee: Simplicity Pattern Co. Inc., Antioch, TN (US)

( * ) Notice: Subject to any disclaimer, the term of this patent is extended or adjusted under 35 U.S.C. 154(b) by 456 days.

(21) Appl. No.: 13/438,381

(22) Filed: Apr. 3, 2012

(65) Prior Publication Data

US 2013/0255047 A1 Oct. 3, 2013

(51) Int. Cl.
*D04H 18/02* (2012.01)
*D04H 17/00* (2006.01)

(52) U.S. Cl.
CPC ..... *D04H 17/00* (2013.01); *D04H 18/02* (2013.01)
USPC ..... 28/107; 28/109

(58) Field of Classification Search
CPC ..... D04H 17/00; D04H 18/02
USPC ..... 28/107, 108, 109, 110, 111, 113, 115; 112/80.03, 80.04, 80.06, 80.05
See application file for complete search history.

(56) References Cited

U.S. PATENT DOCUMENTS

| | | | | |
|---|---|---|---|---|
| 2,682,842 | A * | 7/1954 | Salle | 112/80.04 |
| 2,753,820 | A * | 7/1956 | Lustig | 112/80.04 |
| 3,112,549 | A | 12/1963 | Smith, II | |
| 3,613,190 | A | 10/1971 | Crosby | |
| 3,703,752 | A | 11/1972 | Schulte | |
| 4,070,738 | A | 1/1978 | Göbel | |
| 4,267,784 | A * | 5/1981 | Heemstra | 112/80.04 |
| 4,384,393 | A | 5/1983 | Asselin | |
| 4,388,881 | A * | 6/1983 | Price | 112/80.04 |
| 4,891,870 | A | 1/1990 | Müller | |
| 5,003,674 | A * | 4/1991 | Cohen et al. | 28/109 |
| 5,226,217 | A * | 7/1993 | Olry et al. | 28/107 |
| 7,430,790 | B1 | 10/2008 | Bowles et al. | |
| 2009/0101052 | A1 * | 4/2009 | Tamura | 112/104 |
| 2013/0045654 | A1 * | 2/2013 | von der Fecht | 442/402 |

FOREIGN PATENT DOCUMENTS

| | | | | |
|---|---|---|---|---|
| DE | 4122991 | A1 * | 1/1993 | D04H 18/00 |
| DE | 102010007225 | B3 * | 7/2011 | |
| GB | 618165 | A * | 2/1949 | |
| GB | 1414396 | A * | 11/1975 | |

(Continued)

OTHER PUBLICATIONS

English language machine translation of DE 4122991 A1. Pub. Jan. 1993. translation 5 pages.*

(Continued)

*Primary Examiner* — Amy Vanatta
(74) *Attorney, Agent, or Firm* — Foley & Lardner LLP

(57) ABSTRACT

A hand held felting device includes a body with one or more felting needles and a handle attached thereto for manually felting materials. A motor is provided in the body and is configured to selectively move a shaft reciprocally along the vertical axis upon receipt of power from a power source. The felting needle(s) are mounted to the shaft in the body and thus are configured to move continuously in a reciprocal motion when activated by the motor to felt two or more materials together as a user manually moves the device relative to two or more materials. A safety switch is included with the device in order to selectively activate the motor to move the needle(s). A guard may be operatively associated with the switch to prevent access to the needle(s) and reduce user injury. The needle(s) can be replaced as needed.

8 Claims, 3 Drawing Sheets

(56) References Cited

FOREIGN PATENT DOCUMENTS

| | | | | |
|---|---|---|---|---|
| GB | 2010350 A | * | 6/1979 | |
| GB | 2126612 A | * | 3/1984 | ..... D04H 1/20 |
| GB | 2129453 A | * | 5/1984 | ..... D05C 15/08 |

OTHER PUBLICATIONS

881482001 Deluxe Felting Machine. [online] Simplicity Creative Group, 2011 [retrieved on Jan. 10, 2012]. Retrieved from the Internet <URL: http://www.simplicity.com/p-6226-deluxe-felting-machine.aspx>.

FM-725. [online] Janome, 2007 [retrieved on Jan. 27, 2012]. Retrieved from the Internet <URL: http://content.janome.com/index.cfm/Machines/Specialty/FM-725>.

Embellisher (EMB7). [online] Baby Lock, 2012 [retrieved on Jan. 27, 2012]. Retrieved from the Internet <URL: http://www.babylock.com/sewing/embellisher/>.

"Using Your Simplicity Felting Machine". [online] Fabric Depot, Aug. 17, 2011 [retrieved on Jan. 10, 2012]. Retrieved from the Internet <URL: http://www.fabricdepot.com/blog/?p=1733>.

* cited by examiner

A-A

HAND HELD FELTING MACHINE

BACKGROUND

1. Field

The present disclosure relates to a portable, powered hand held machine for felting a material.

2. Description of Related Art

Various crafts can use fabrics or materials that are meshed together through a process called felting. For example, quilters can use pieces of felted fabrics.

Industrial machines such as those disclosed in U.S. Pat. Nos. 3,703,752; 4,070,738; 4,384,393; 4,891,870; and 7,430,790 have been used to produce felted webs of material. One disadvantage of such devices is that a user is generally limited to factory or industrial produced designs of a larger scale.

Personal felting machines in the form of table-top designs that look like sewing machines have been provided in the market by companies such as Janome and Baby Lock, and the noted assignee, Simplicity. However, such machines can be limiting, in that they are limited in area for which the fabric can be moved in, as well as an area that the machine is positioned on. Moreover, performing felting on smaller areas is difficult.

SUMMARY

One aspect of the disclosure provides a hand held felting device. The device has a body with a motor therein that is configured to selectively receive power from a power source. A handle is attached to the body for holding and for moving the body relative to materials for felting. One or more felting needles are mounted to a shaft in the body that is configured to move the one or more felting needles in a continuously reciprocal motion. The motor is configured to selectively move the shaft reciprocally upon receipt of power from the power source such that the one or more felting needles are moved continuously reciprocally in order to felt two or more materials together when the body is positioned adjacent and relative to the two or more materials.

Another aspect of the disclosure provides a portable felting device. The device has a body with a motor therein that is configured to selectively receive power from a power source. A handle is attached to the body for holding and for moving the body relative to materials for felting, and one or more felting needles are removably mounted to a needle holder. The needle holder is removably connected to a shaft in the body that is configured to move the one or more felting needles in a continuously reciprocal motion upwardly and downwardly along a vertical axis. The motor is configured to selectively move the shaft reciprocally along the vertical axis upon receipt of power from the power source such that the one or more felting needles are moved to felt two or more materials together. The device also includes a safety switch that is configured for movement between a first position for preventing movement of the shaft and the one or more felting needles and a second position for activating the motor to move the shaft and the one or more felting needles continuously reciprocally.

Yet another aspect of the disclosure includes a method for felting materials using a hand held felting device having a body with a motor therein that is configured to selectively receive power from a power source; a handle attached to the body for holding and for moving the body relative to materials for felting; and one or more felting needles mounted to a shaft in the body, the shaft configured to move the one or more felting needles in a continuously reciprocal motion. The motor is configured to selectively move the shaft reciprocally upon receipt of power from the power source such that the one or more felting needles are moved continuously reciprocally in order to felt two or more materials together. The method includes:

providing the hand held felting device;

providing the materials;

providing power to the motor from the power source;

manually positioning the one or more felting needles adjacent to the materials, and felting the materials.

These and other features, aspects, and advantages of the present disclosure will become apparent from the following detailed description of the preferred embodiments relative to the accompanied drawings, and the appended claims.

DETAILED DESCRIPTION

The hand held felting device of the present disclosure is designed to felt two or more materials together, such as, but not limited to, yarn, cotton, silk, satin, felt, wool, and canvas. Needle felting is a process that meshes fiber to fiber with an up and down motion. As will be described further herein, the felting of the materials is accomplished by manually moving the device in an up and down motion across fibers of the material. The device can use any number of interchangeable needles, which are held in a needle holder that is attached to a shaft that is selectively movable by a motor. Moreover, in an embodiment, a retractable guard is used as a safety device that limits power to the motor until fully compressed. The hand held felting device may be used to felt materials for smaller projects or in reduced areas, such as those used in any type of project including crafting, sewing, embellishing, needlework, and quilting, for example.

Figure 1:
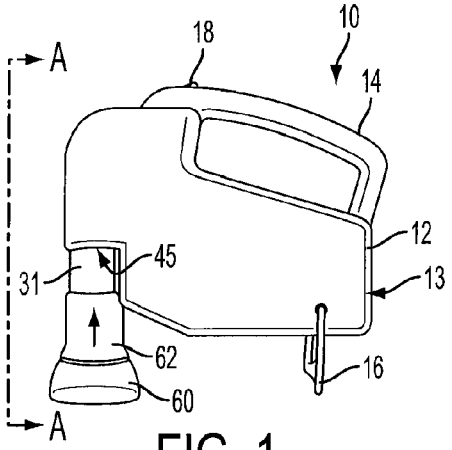
FIG. 1 shows a side view of a hand held felting device in accordance with an embodiment of this disclosure.
Figure 2:
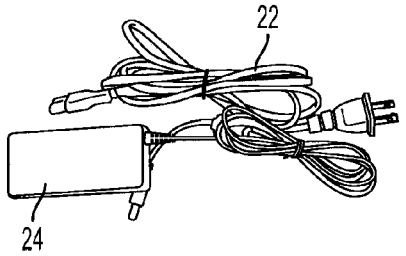
FIG. 2 shows a side view of a power supply device and cord for use with the device of FIG. 1.

FIG. 1 illustrates a side view of a hand held felting device 10 in accordance with an embodiment of this disclosure. The hand held felting device 10 includes a housing or body 12 that is configured to house motor 20, a gear train 26, safety switch 28, driver 30, shaft 32, and other components for supplying power and movement to the parts of hand held felting device 10. Motor 20, such as an electrically powered motor (see FIG. 3), is contained in the body 12 and is configured to selectively receive power from a power source. For example, an input jack 13 may be provided on a rear side of the body 12 to receive a plug device with power cord 22 and power supply 24, such as shown in FIG. 2. For example, the device may be designed for universal electronic sources and be UL approved for the United States and Australia. The plug device and its cord may be attached directly to, or removably attached to, the device via jack 13, for example. The cord 22 may have a connection device at one end for connection to the power supply 24 and a plug at its other end for connection to an electrical wall outlet. Motor 20 may be an AC induction motor or a DC motor. Motor 20 operates using electrical power to rotatably drive a shaft 32 upon receipt of power so that felting needles mounted in the device 10 are reciprocally moved. In an embodiment, the speed of the motor 20 used in the hand held felting device 10 is between about 800 to about 900 rpms. However, other motor speeds (e.g., 700 rpms) may also be used, and thus it not limiting.

A handle 14 is attached to the body 12 for holding the device and for its portability. Moreover, the handle 14 is used for moving and controlling the body 12 and felting needles therein relative to materials for felting. One or more felting needles 40 are mounted to a shaft 32 in the body 12 and are configured for movement such that fibers of two or more materials can be felted or meshed together. Specifically, the motor 20 is configured to selectively move the shaft 32 reciprocally upon receipt of power from the power source by rotating gears of the gear train 26, which in turn moves the driver 30 that is operatively connected to the shaft 32. The gears of gear train 26 may be spur gears, for example, which are selectively rotated about a respective axis (e.g., horizontal axes). In the exemplary illustrated embodiment of FIG. 3, for example, gear train 26 comprises a first gear 50 that is configured to be rotated about its axis by motor 20. First gear 50 cooperatively rotates a second gear 52 and a third gear 54 about their same axis, which in turn rotates a fourth gear 56 about another axis (each of the axes being horizontally parallel to each other). The rotation of fourth gear 56 operatively causes activation of driver 30. Specifically, the driver 30 is rotated about the same axis as fourth gear 56 in a circular motion. Driver 30 is configured to impart a reciprocating motion to shaft 32 via a crank connection 35 to shaft 32, which is formed by connecting a part of a rotating crank arm of driver 30 to a part on the shaft 32. One or more guides such as guide 36 may be mounted in body 12 to guide and maintain movement of the shaft 32 within the body 12.

The movement of shaft 32 in a reciprocal motion, as indicated by arrow 33, is configured to move the one or more felting needles 40 in a continuously reciprocal motion. As shown in the cross-sectional view of FIG. 3, the shaft 32 and a plurality of felting needles 40 (in this illustrated case, six felting needles) are positioned for a continuously reciprocal motion upwardly and downwardly along a vertical axis Y-Y (an axis that is relative to a height of the machine) such that the needles move into, through, and from fibers of the materials so that the fibers are interlocked and meshed with each other.

Each of the needles is a felting or barbed needle that is configured to catch and intertwine fibers of material(s) it is inserted through. Such needles are generally known in the art and therefore are not described in detail herein. Also, differently sized and shaped felting needles may be used alone or in concert with other differently sized and shaped felting needles.

The vertical stroke of the felting needle(s) 40 used with this device should not be limiting. In an embodiment, the needle stroke of each needle is approximately ¾ inches long.

Figure 3:
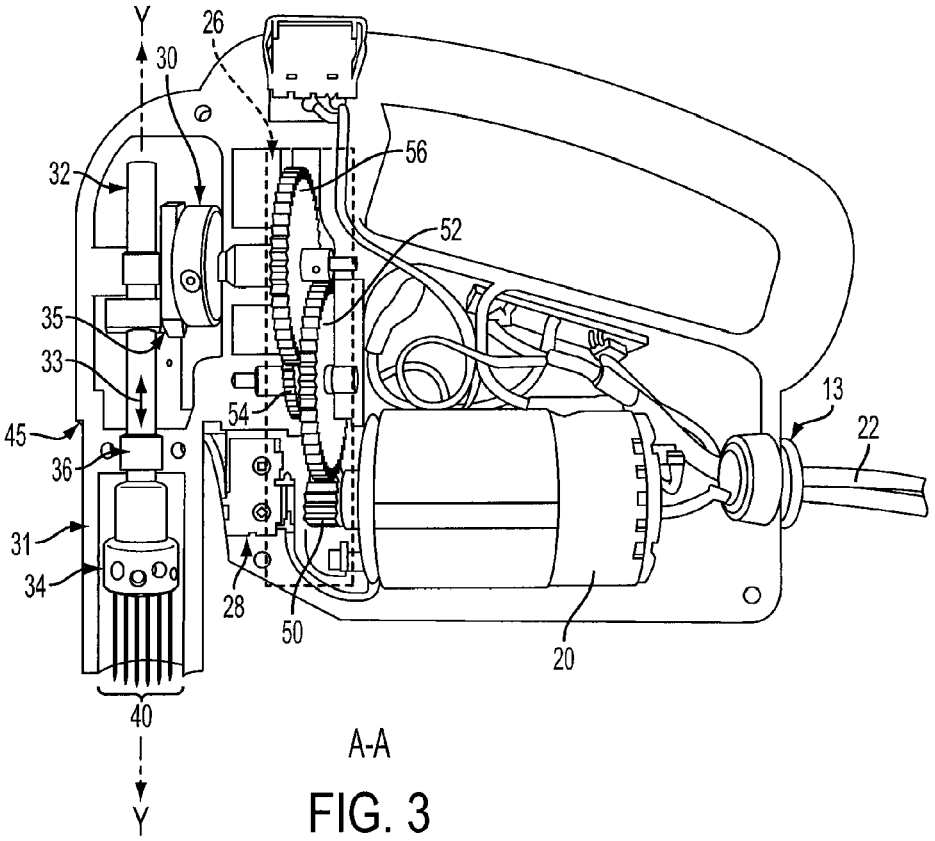
FIG. 3 shows a cross sectional view of the hand held felting device of FIG. 1 taken along line A-A in FIG. 1, showing internal parts of the device.
Figure 4A:
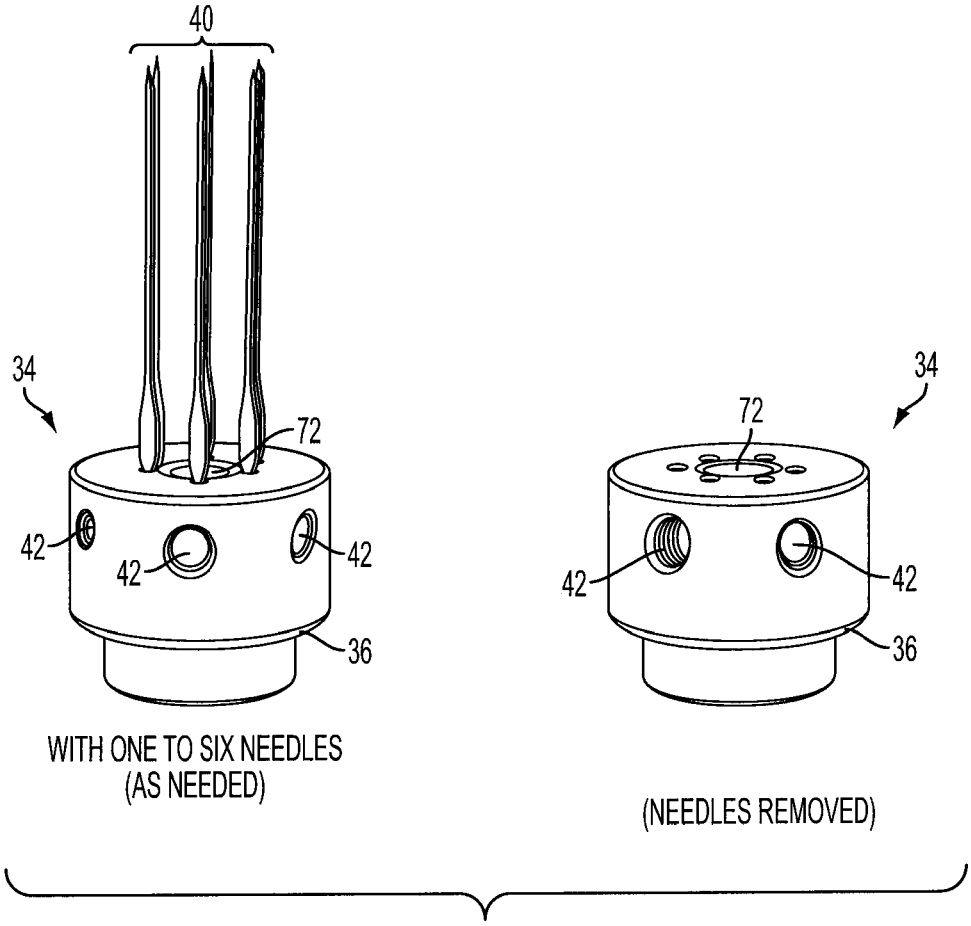
FIGS. 4A and 4B show a detailed plan and top views of a needle holder used in the hand held felting device of FIG. 1, with and without needles therein, in accordance with an embodiment.
Figure 4B:
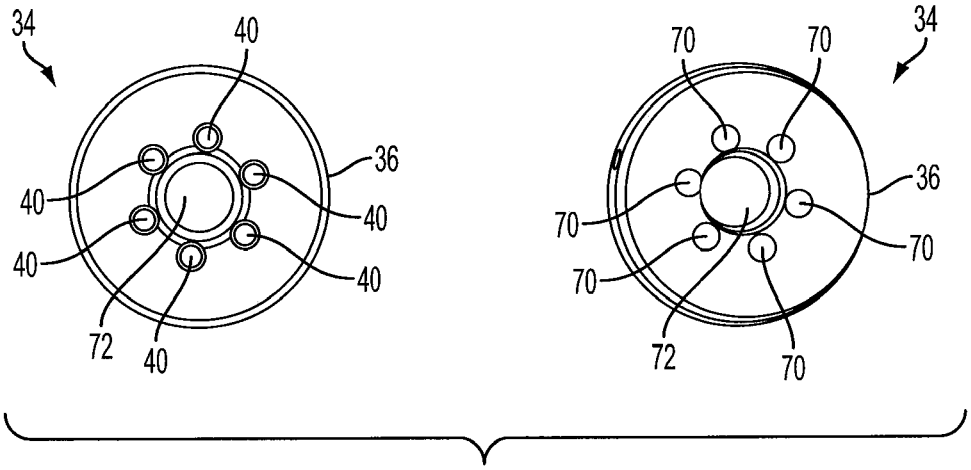

As shown in FIG. 3 and in greater detail in FIGS. 4A and 4B, the hand held felting device 10 may further include a needle holder 34 that is connected to the shaft 32. The needle holder is sized so that it can fit within a stationary extension part 31 of the body 12 (further described below). The one or more felting needles 40 may be configured to be removably mounted to needle holder 34. Needle holder 34 includes a rounded base 36 that has a number of openings 70 accessible on one side (e.g., a bottom or downward facing side) for receiving each of the needles 40 therein. When positioned and mounted in the openings 70, each needle 40 mounted in the needle holder 34 is held and locked in place with fasteners that are perpendicularly accessible through holes 42 around a side of the base 36. The holes 42 are threaded so as to receive a rotatable screw or fastener therein. In an embodiment, needle holder 40 is removably connected to the shaft 32 in the body 12. It can include a bore 72 through a center of the base 36 so as to receive a mounting portion (e.g., a screw attached to shaft 32) therein for connection to the shaft 32.

FIGS. 4A and 4B show views of a needle holder 34 with and without needles therein. The number of felting needles 40 used in the device 10 is not meant to be limiting. For example, in an embodiment, based on the materials being felted, one to six needles may be mounted in needle holder 34. However, any number of felting needles may be used in the machine. In an embodiment, one felting needed is used for felting (e.g., for finer detail work). In another embodiment, six felting needles are used for felting. Also, more than six needles may also be used. The needle holder 34 can be configured to hold any number of felting needles therein.

Figure 5:
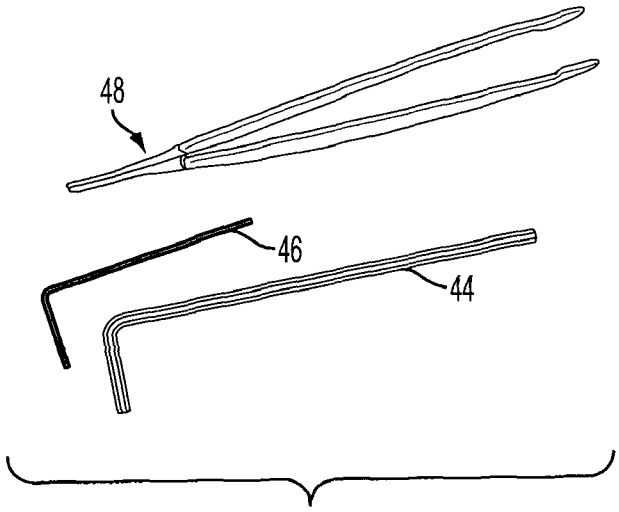
FIG. 5 shows accessories for use with the hand held felting device of FIG. 1.

To remove and/or replace needles in the needle holder 34, tools such as allen wrenches 44 and 46 and tweezers 48, shown in FIG. 5, may be included with the hand held felting device 10. The longer allen wrench 44 can be inserted into the device 10 (e.g., into the body 12) and into a fastener or allen screw inside the needle holder 40 (e.g., in a center portion thereof), then turned to loosen the respective screw. Using tweezers 48, a user can grasp a needle or the holder itself and slide or pull the needle holder 40 out of the machine. Then, using the shorter and smaller allen wrench 46, a user can insert an end thereof into a hole 42 of the needle holder 40. Each hole 42 has a fastener or allen screw inside for holding and locking needles 40 therein (e.g., the fastener extends perpendicularly to the needle). The screw holding the needle for removal/replacement can be loosened by turning the allen screw in the respective hole 42. Then, using tweezers 48, the user can remove the old needle, and then insert a new needle into the needle opening. The user can hold the new needle in its opening while turning and tightening the allen screw in hole 42. After any or all of the needles 40 are removed or replaced, as needed, the needle holder 40 can be inserted back into the machine using tweezers 48, and then tightening the allen screw of the needle holder 40 using wrench 44, to secure the holder in place for use.

In accordance with an embodiment, different types of needle holders can be used with hand held felting device 10. For example, the removable felting needles 40 can be placed into modified needle holder (not shown) and mounted into the device 10 for use.

The hand held felting device 10 also includes a power (ON/OFF) switch 18 to control operation of and power to the portable device. The power switch 18 may be provided on a top side of body 12—on handle 14, for example—or anywhere else (e.g., a side wall) on the device 10. On/off switch 18 includes a switch module (generally shown in FIG. 3) mounted on an inside wall of body using fastening devices, and a manually engageable portion that moves pivotally between an ON position and an OFF position (i.e., a rocker switch). The switch module has a movable element (not shown) that connects to the manually engageable portion to move the switch module between its states. Movement of the manually engageable portion of switch 18 moves the switch module between states. In the illustrated embodiment shown in FIG. 3, the switch module connects a motor 20 to the power supply. This connection may be direct or indirect, such as via a controller.

In order to reduce or prevent injury to a user and to provide better control of the device 10 when felting, a safety switch 28 may be included with the device in order to selectively activate the motor 20 to move the needles 40 (or, alternatively, selectively prevent the motor 20 from moving the shaft 32). The safety switch 28 is configured for movement between a first position for preventing movement of the shaft 32 and the one or more felting needles 40 (e.g., by preventing activation of motor 20 for rotating gear train 26) and a second position for activating the motor 20 to move the shaft 32 and the one or more needles 40 continuously reciprocally.

In an embodiment, hand held felting device further includes a needle guard 60 operatively associated with the safety switch 28. The needle guard 60 is configured to shield access to at least the ends of the one or more felting needles 40 in an extended (first) position and allow use of the one or more felting needles in the retracted (second) position. More specifically, body 12 has a stationary extension part 31 surrounding needle holder 34 and needles 40 when mounted in the body, and a movable arm 62 connected to the stationary extension part 31. The movable arm 62 moves relative to the stationary extension part 31. Attached to an end of the movable arm 62 is needle guard 60. Throughout this disclosure, it should be understood that any reference to movement of guard 60 also includes movement of movable arm 62.

The movable arm 62 and/or needle guard 60 are spring-loaded relative to stationary extension part 31 via one or more resilient devices (not shown). The resilient devices (springs) are mounted in the body 12 in order to force the arm 62 and guard 60 into a default extension position. By applying pressure to a bottom portion of needle guard 60, for example, the springs are compressed, and both the needle guard and moveable arm 62 are moved to cover stationary extension part 31 and retracted towards an edge 45 of the body 12. In addition to shielding a user from the needles, the needle guard 60 also cooperatively works with the safety switch 28. Movement of the needle guard 60 between the extended position (where movable arm 62 is away from edge 45) and the retracted position (where movable arm 62 is adjacent edge 45) triggers movement of the safety switch 28 between the first position (in which it is activated to prevent the motor from running) and the second position (in which it is deactivated), respectively. That is, when the guard 60 is extended the safety switch 28 is provided in a position that prevents motor from running, and when the guard 60 is retracted, the safety switch is provided in a position to activate the motor.

In an embodiment, the needle guard 60 is moved to the second position when manual pressure is applied (e.g., in a downward direction) and used to push and compress the guard vertically in an upward direction (e.g., as shown by arrow B in FIGS. 1 and 6) to the retracted (second) position from the extended (first) position (e.g., when pushed towards a work piece or materials for felting). Once the pressure or force is released, the force in the compressed springs moves the arm 62 and guard 60 back towards the extended position. Additional details regarding movement of guard 60 and use of the hand held felting device 10 are described further below.

Placement of the needle guard 60 in the retracted (second) position controls the safety switch 28 and thus activates the motor 20 to move the shaft 32 and the one or more needles 40 continuously reciprocally for felting. For example, even though a user may turn the power switch 18 to an "ON" position, the motor 20 would not rotate gear train 26 and thus move shaft 32 and needles 40. Once the guard is compressed, power is supplied to the motor, and the shaft 32 and needles 40 reciprocate. Needle guard 60 allows a user to selectively enable the operation of the device 10. Generally, the construction and operation of the switches 18 and 28 and devices for controlling a motor are well known, and any construction for these may be used.

Needle guard 20 is open at a bottom end to enable needles 40 to selectively extend outwardly therefrom when guard 60 is retracted. Needle guard 20 can be made of a clear material, such as a molded plastic, to enable the user to see the one or more needles 40 therethrough (e.g., so that a number of needles 40 mounted in needle holder 34 may be easily viewed).

In some embodiments, the guard 60 does not allow the motor to start movement of the needles 40 until it is fully compressed a predetermined distance. The predetermined amount or distance which needle guard 60 needs to be moved or compressed can vary, and should not be limiting. In an embodiment, for example, the guard is configured for moving at least one inch before the motor 20 is activated. In another embodiment, the predetermined distance is determined based on the distance which an edge of movable arm 62 moves to be positioned adjacent to edge 45. In an embodiment, when the pressure towards a work piece is released by the user, such that the guard 60 is no longer retracted the minimum predetermined distance (e.g., the movable arm 62 moves away from edge 45), the safety switch is triggered and the motor 20 is deactivated, thus stopping movement of the needles 40.

Figure 6:
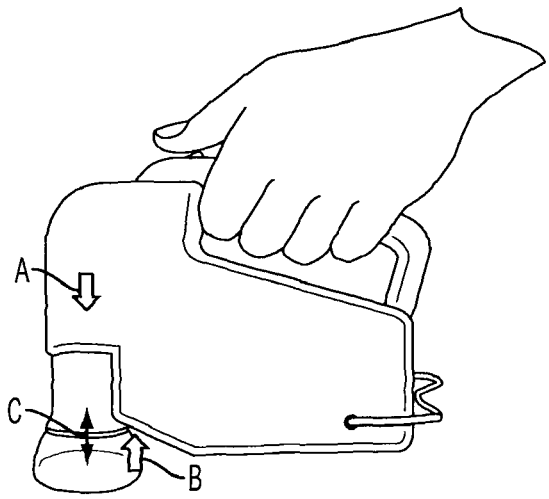
FIG. 6 illustrates a method of use of the hand held felting device of FIG. 1.

When using the hand held felting device 10 for felting, such as shown in FIG. 6, it is helpful to use a support such as a felting foam material on a back side of the material(s). This also prevents damage to the ends of the needles 40 as they puncture the support and it allows the needles to move through the fibers. The material or fiber for felting can be placed on a base of the support/felting foam. Felting can be performed in small sections, with the option of adding fibers/materials and layering the same to form a work piece for felting.

Once fibers are ready to be felted and positioned on the support, for example, the hand held felting device 10 is placed adjacent to or on top of the work piece. The power supply 24 for the device 10 is attached to the input jack 13 on the body 12 and a plug at the end of electric supply cord 22 is plugged into a polarized electrical outlet or wall socket. A user grasps the handle 14 and turns the power switch 18 is turned to its "ON" position. Using handle 14, the user can apply manual pressure in a downward direction towards the work piece such that the needle guard 60 and movable arm 62 are retracted towards the body 12 and the safety switch 28 is deactivated, thus activating the motor 20 and the reciprocal movement of the one or more felting needles 40. The user can continue to manually move the device 10 in an up and down motion across and around the fibers of material. When the motor 20 is turned on, the needles 40 will be pushed down into the foam to secure the fibers (as you push down) and continuously moved in a reciprocating manner for felting. When the device is lifted away from the work piece, the needle guard 60 and movable arm 62 are released (e.g., via spring motion) to cover the needles 40 and stop movement thereof.

The needles 40 do not need to be held in one place for a long period of time. A user can optionally move and apply the device 10 around a desired area to have the area for felting at least partially meshed, and then move the device over the entire work piece area several times until all of the fibers are secured to the user's satisfaction. The longer the fibers are punctured by the needles 40, the more fused they will become. Both of the front side of the felted fabric and its back side will have been textured from the fibers that have been meshed together.

Once the felting of the work area on the work piece is complete to a user's satisfaction, the device 10 can be lifted to deactivate the motor 20. The power switch can be turned to its "OFF" position when the device 10 is not in use.

In an embodiment, it is envisioned that the hand held felting device may receive power from batteries supplied in a battery compartment (not shown). The battery compartment may be provided as an alternative to or in addition to an electrical cord with a plug.

Accordingly, the herein disclosed hand held felting device 10 provides a portable, powered machine configured to felt materials, including materials with a reduced working area and/or that require smaller details, such as in areas that a standard power table machine can not be used, e.g., inside a pocket or pant leg, or within a middle of a project. The needles 40 are configured to mesh or intertwine fibers together to create new color and/or texture combinations.

The device 10 includes safeguards to ensure safety and prevent and/or reduce injury to the user. For example, switch 28 is designed to prevent reciprocal movement of the shaft 32 (and hence, the felting needle(s) 40) via deactivating the motor 20 when the needle guard 60 is in an extended, first position. Also, needle guard 60 is provided to prevent direct and/or accidental access to the needles mounted in the machine. Turning power off to the machine manually (e.g., using power switch 18 or unplugging it) and/or using switch 28 and guard 60 aids in preventing accidental injury to the user.

The construction and configurations of hand held felting device 10 are shown as examples and not intended to be limiting. Any parts of the device 10 may be made of plastic, metal, other materials, or any combination thereof. The parts of the device 10 may optionally be made from molded plastic. Also, each of the features described herein may be formed separately or integrally with the structures they are associated with. Devices such as fasteners, screws, or bolts, nuts, glue or adhesive, or other attachment and/or fastening devices may be used to secure parts together, if needed. Additionally and/or alternatively, shock absorbing elements, vibration absorbing elements, and/or springs may be used in hand held felting device 10.

While the principles of the disclosure have been made clear in the illustrative embodiments set forth above, it will be apparent to those skilled in the art that various modifications may be made to the structure, arrangement, proportion, elements, materials, and components used in the practice of the disclosure. For example, it is to be understood that indicia may be provided on the housing of the hand held felting device.

It will be appreciated that variations of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A hand held felting device comprising:

a body comprising a motor therein that is configured to selectively receive power from a power source;

a handle attached to the body for holding and for moving the body relative to materials for felting;

one or more felting needles mounted to a shaft in the body, the shaft configured to move the one or more felting needles in a continuously reciprocal motion;

a safety switch configured to selectively activate the motor for moving the shaft; and a guard operatively associated with the safety switch, wherein the motor is configured to selectively move the shaft reciprocally upon receipt of power from the power source such that the one or more felting needles are moved continuously reciprocally in order to felt two or more materials together when the body is positioned adjacent and relative to the two or more materials, and wherein the guard is configured for movement between a first position for preventing access to and movement of the one or more felting needles and a second position for allowing access to the one or more felting needles for felting materials, and wherein placement of the guard in the second position further releases the safety switch and activates the motor to move the shaft and the one or more needles continuously reciprocally.

2. The device according to claim 1, wherein the guard is moved to the second position when manual pressure is applied thereto.

3. The device according to claim 2, wherein the guard is configured to move vertically in an upward direction to the second position from the first position.

4. The device according to claim 1, further comprising a needle holder, wherein the one or more felting needles configured to be removably mounted to a needle holder and wherein the needle holder is removably connected to the shaft in the body.

5. A portable felting device comprising:

a body comprising a motor therein that is configured to selectively receive power from a power source;

a handle attached to the body for holding and for moving the body relative to materials for felting;

one or more felting needles removably mounted to a needle holder, the needle holder being removably connected to a shaft in the body, the shaft configured to move the one or more felting needles in a continuously reciprocal motion upwardly and downwardly along a vertical axis;

the motor being configured to selectively move the shaft reciprocally along the vertical axis upon receipt of power from the power source such that the one or more felting needles are moved to felt two or more materials together;

a safety switch being configured for movement between a first position for preventing movement of the shaft and the one or more felting needles and a second position for activating the motor to move the shaft and the one or more needles continuously reciprocally, and a guard operatively associated with the safety switch, the guard configured to shield access to the one or more felting needles in an extended position and allow use of the one or more felting needles in the retracted position, and wherein movement of the guard between the extended position and the retracted position triggers movement of the safety switch between the first position and the second position.

6. The device according to claim 5, wherein the guard is moved to the retracted position when pressure is applied thereto.

7. The device according to claim 6, wherein the guard is configured to move vertically in an upward direction to the retracted position from the extended position.

8. A method for felting materials using a hand held felting device comprising a body comprising a motor therein that is configured to selectively receive power from a power source; a handle attached to the body for holding and for moving the body relative to materials for felting; and one or more felting needles mounted to a shaft in the body, the shaft configured to move the one or more felting needles in a continuously reciprocal motion, the motor being configured to selectively move the shaft reciprocally upon receipt of power from the power source such that the one or more felting needles are moved continuously reciprocally in order to felt two or more materials together, a safety switch being configured for movement between a first position for preventing movement of the shaft and the one or more felting needles and a second position for activating the motor to move the shaft and the one or more felting needles continuously reciprocally, and a guard configured to shield access to the one or more felting needles in an extended position and allow use of the one or more felting needles in the retracted position; the method comprising:

providing the hand held felting device;

providing the materials;

providing power to the motor from the power source;

manually positioning the one or more felting needles adjacent to the materials; and felting the materials;

moving the safety switch from the first position to the second position, and applying pressure to the guard such that it moves from the extended position to the retracted position, thus activating the motor to move the shaft and the one or more felting needles for felting.

* * * * *